US012053712B2

(12) United States Patent
Ng et al.

(10) Patent No.: US 12,053,712 B2
(45) Date of Patent: Aug. 6, 2024

(54) ELASTIC BAND MODEL KIT

(71) Applicant: Choon's Design LLC, Farmington Hills, MI (US)

(72) Inventors: Cheong Choon Ng, Novi, MI (US); Jacob Minor, Howell, MI (US)

(73) Assignee: CHOON'S DESIGN LLC, Farmington Hills, MI (US)

( * ) Notice: Subject to any disclaimer, the term of this patent is extended or adjusted under 35 U.S.C. 154(b) by 0 days.

(21) Appl. No.: 17/993,260

(22) Filed: Nov. 23, 2022

(65) Prior Publication Data

US 2024/0091658 A1 Mar. 21, 2024

Related U.S. Application Data

(60) Provisional application No. 63/406,903, filed on Sep. 15, 2022.

(51) Int. Cl.
*A63H 3/50* (2006.01)
*A63H 33/06* (2006.01)

(52) U.S. Cl.
CPC ..... *A63H 3/50* (2013.01); *A63H 33/065* (2013.01)

(58) Field of Classification Search
CPC ..... A63H 33/50; A63H 33/065
USPC ..... 446/72, 86, 87, 97, 268, 474
See application file for complete search history.

(56) References Cited

U.S. PATENT DOCUMENTS 923,863 A * 6/1909 Lehr ..... A63F 9/0876 273/159
2,728,149 A * 12/1955 Radt ..... A63F 9/0876 428/542.6
2,764,842 A * 10/1956 Swann ..... A63H 3/08 446/388
2,798,328 A * 7/1957 Fasino ..... B44C 3/00 2/244
2,932,908 A * 4/1960 Gough ..... G09B 19/02 434/327
2,984,488 A * 5/1961 Kirchner ..... A63F 9/06 273/157 R
3,905,133 A * 9/1975 Charman ..... A63H 33/22 446/85
4,041,637 A * 8/1977 Whitman ..... A63F 9/0669 446/72
4,227,335 A * 10/1980 Kuna ..... A63H 33/22 112/80.03
4,294,036 A * 10/1981 Wion ..... A63H 3/10 428/16

(Continued)

OTHER PUBLICATIONS

European Search Report for European Application No. 23197300.9 mailed Feb. 6, 2024.

*Primary Examiner* — Joseph B Baldori
(74) *Attorney, Agent, or Firm* — Carlson, Gaskey & Olds, P.C.

(57) ABSTRACT

A kit and components for creating an elastic band model includes a form including at least one band retaining member. Elastic bands of different colors are assembled to the form using the band retaining member to hold the a plurality of linked elastic bands in place. The elastic bands fill out the form to create the shape and look of the model. The forms are part of a kit that includes the forms applicable to each unique model along with other components unique to that models shape and appearance.

27 Claims, 7 Drawing Sheets

(56) References Cited

U.S. PATENT DOCUMENTS 4,445,950 A * 5/1984 Browning ..... B44C 1/00 156/92
4,493,654 A * 1/1985 Stuart ..... G09B 3/12 434/347
4,540,375 A * 9/1985 Fogarty ..... A63H 33/22 242/395
4,667,965 A * 5/1987 Helms, Jr. ..... A63F 9/0073 273/282.1
5,328,374 A * 7/1994 Stevens ..... G09B 23/04 434/211
5,733,170 A * 3/1998 Wotton ..... A63H 3/02 446/385
6,065,968 A * 5/2000 Corliss ..... G09B 23/04 434/211
6,149,436 A * 11/2000 Dunn ..... G09B 11/00 434/81
6,213,918 B1 * 4/2001 Rogers, Jr. ..... A63B 23/16 601/40
6,705,867 B2 * 3/2004 Foght ..... G09B 19/20 434/96
D564,022 S * 3/2008 Russo ..... D19/108
7,909,609 B2 * 3/2011 Molin ..... G09B 23/04 434/188
8,485,565 B2 * 7/2013 Ng ..... D04D 7/04 289/17
8,684,420 B2 * 4/2014 Ng ..... D04D 7/02 289/17
8,931,811 B1 * 1/2015 Ng ..... D04B 5/00 289/17
8,936,283 B2 * 1/2015 Ng ..... D04D 7/02 289/17
8,955,888 B2 * 2/2015 Ng ..... A44C 5/0069 289/17
8,973,955 B2 * 3/2015 Ng ..... D04D 7/04 289/17
9,695,528 B1 * 7/2017 Smith ..... D03D 29/00
9,750,315 B2 * 9/2017 Ng ..... B65H 69/04
9,848,679 B2 * 12/2017 Ng ..... A44C 27/00
9,903,055 B2 * 2/2018 Todokoro ..... D04B 5/00
10,478,740 B2 * 11/2019 Sakai ..... A63H 33/00
10,791,807 B2 * 10/2020 Ng ..... D04D 7/02
10,940,398 B2 * 3/2021 Smelcer ..... A63H 3/365
11,019,891 B2 * 6/2021 Ng ..... B65H 69/00
11,337,497 B2 * 5/2022 Ng ..... D04D 7/02
2010/0105013 A1 * 4/2010 McCafferty ..... B65H 49/322 434/83
2015/0296937 A1 * 10/2015 Ng ..... D04D 11/00 289/17
2019/0038983 A1 * 2/2019 Matos ..... A63H 3/10

* cited by examiner

ELASTIC BAND MODEL KIT

CROSS REFERENCE TO RELATED APPLICATION

This application claims priority to U.S. Provisional Application Ser. No. 63/406,903 filed on Sep. 15, 2022.

BACKGROUND

This disclosure generally relates to kit, device and method for creating a model using elastic bands. More particularly, this disclosure relates to a kit, device and method for creating models from elastic bands combined with a support structure.

Models, action figures and other characters continue to be popular with children of all ages. Models, action figures and characters can be bought as a complete item that is ready to enjoy without any additional effort by a user. Without some effort by the user, the interest and enjoyment can soon fade and the purchased completed model or action figure may soon be left unused. A kit where the child assembles components and parts to create the model or action figure can provide a sense of satisfaction and accomplishment. Assembly of a model or action figure provides a much more beneficial and satisfying experience for a child. Additionally, the assembling of a kit teaches and reinforces valuable skills and encourages creativity.

SUMMARY

A kit and components for creating a model according to an example disclosed embodiment includes, among other possible things, at least one form including at least one band retaining member. Elastic bands of different colors are assembled to the form using the band retaining member to hold the a plurality of linked elastic bands in place. The elastic bands fill out the form to define the character and appearance of the model. The forms are part of a kit that includes the forms applicable to each unique model along with other components unique to that figures shape and appearance.

Although the different examples have the specific components shown in the illustrations, embodiments of this disclosure are not limited to those particular combinations. It is possible to use some of the components or features from one of the examples in combination with features or components from another one of the examples.

These and other features disclosed herein can be best understood from the following specification and drawings, the following of which is a brief description.

DETAILED DESCRIPTION

Figure 1:
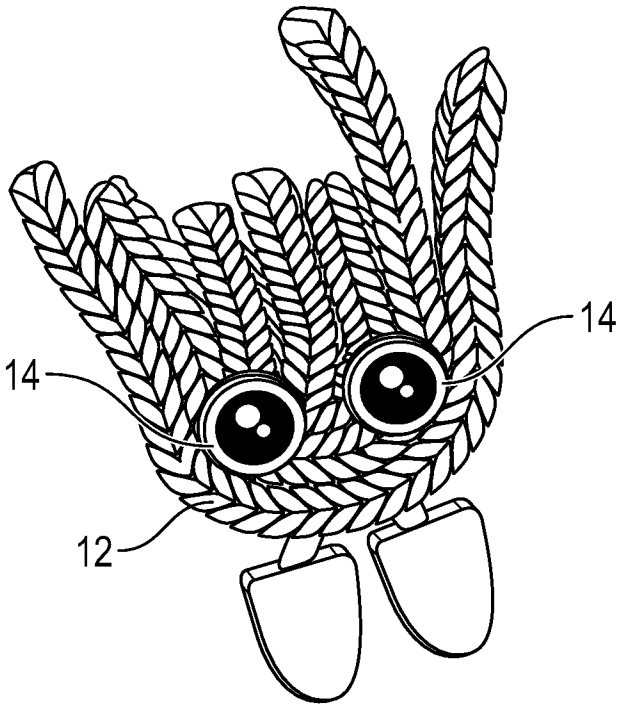
FIG. 1 is a front view of several models formed with elastic bands and forms according to disclosed example embodiments.
Figure 1:
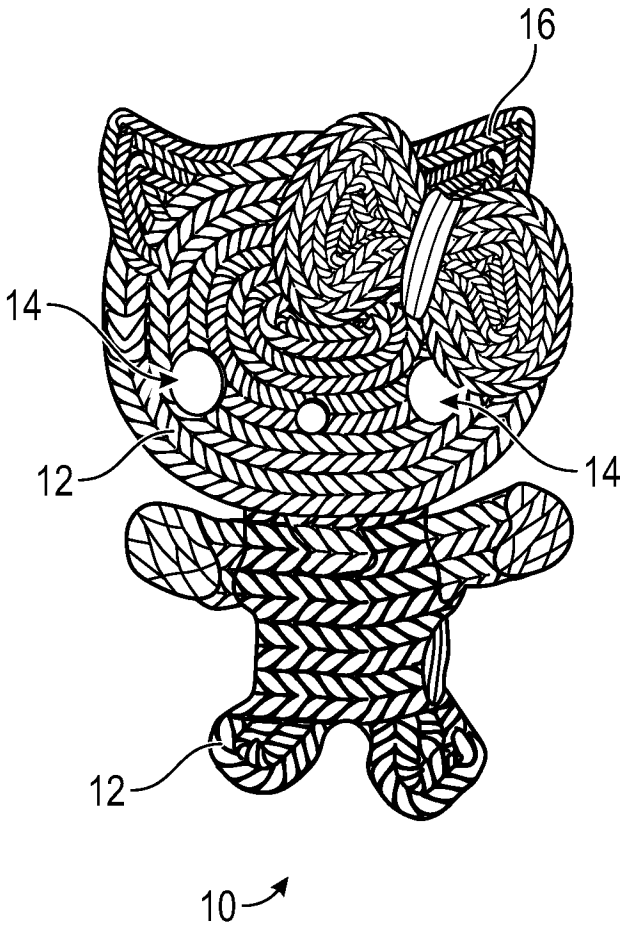
Figure 2:
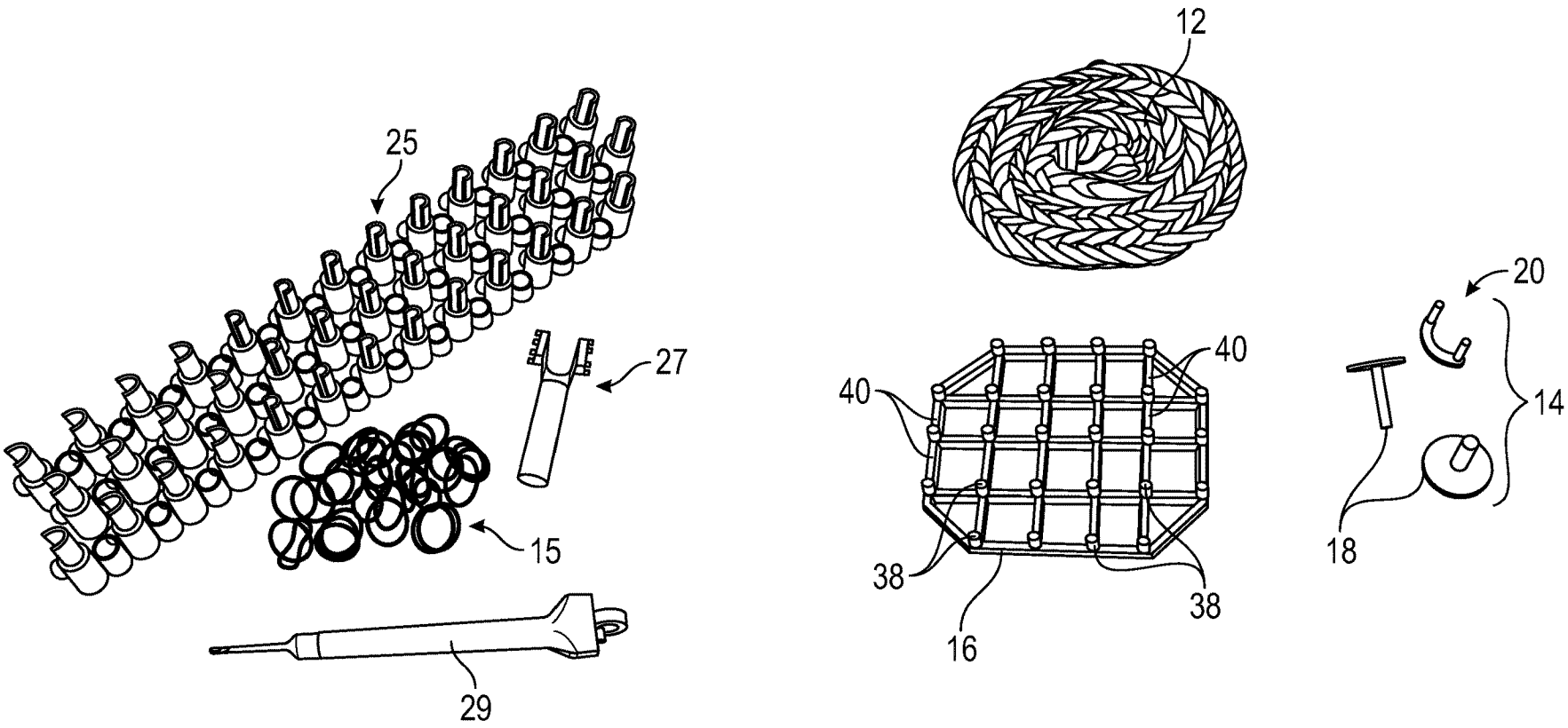
FIG. 2 is a perspective view of a disclosed example kit embodiment for making an elastic band model.

Referring to FIGS. 1 and 2, a plurality of models 10 are shown that are formed from linked elastic bands 15 formed into a linked elastic band assembly 12 combined with forms 16 and inserts 14. The models 10 are formed with a kit 22 that includes at least the forms 16 that are applicable to each unique model shape. The kit 22 may also include one or more inserts 14 to form features of a completed model. Such features formed by the inserts 14 can include, eyes, mouth or other features that are applicable to the unique model. The kit 22 may further include elastic bands 15 of varying complementary colors for assembly into the linked elastic band assembly 12.

The kit 22 may include further items within the scope and contemplation of this disclosure. For example, the kit 22 may include a loom 25 for creating the linked elastic band assembly from a plurality of elastic bands 15. The loom 25 provides for holding of the elastic bands 15 while they are linked together. Another loom 27 may be utilized to hold the elastic bands to form a linked structure as shown at 12. The loom 25 provides for linking of the elastic bands in various combinations. A hook tool 29 may also be included to aid in manipulating the elastic bands on the loom 25 to create the linked band assembly 12. The disclosed looms 25, 27 are shown by way of example and other looms for holding the elastic bands during the linking process are within the scope and contemplation of this disclosure.

As is shown in FIG. 1, the shape, size, color for the inserts 14 and form 16 may vary to provide for the creation of a model that depicts different characters, figures and any other 3D object model in combination with a linked elastic band structure. The example model maybe be formed as a representation of a character, animal, creature, object or any other desired shape. For example, the model may be configured to create a likeness of a character as shown, or other objects and shapes such as a car, plane, symbol, animal, cartoon, planet, rocket or any other shape. This list is not intended to be exhaustive and other shapes and objects may be formed and are within the contemplation and scope of this disclosure.

The linked elastic band assembly 12 are formed using different link structures formed with the elastic bands 15, such as for example, a Brunnian link structure. A Brunnian link is a link that uses a closed loop member, such as the example elastic bands 15. A Brunnian link includes one closed loop folded and doubled over itself to capture another closed loop to form a chain. The linked elastic bands 12 provide fill for portions of the model and are secured to the forms 16.

In one disclosed example embodiment, the kit 22 includes the form 16 that is provided in one example embodiment as a structure with ribs 40 that form a grid structure, inserts 14 and a plurality of elastic bands 15. The elastic band assembly 12 shown in FIG. 2 is formed from the elastic bands 15 and assembled to the form 16 to fill in the disclosed shape. It should be appreciated that the linked elastic band assembly 12 could be formed in other shapes and colors to provide different appearances. In this example, the inserts 14 include eye-shaped insets 18 and a mouth-shaped insert 20.

The form 16 includes a plurality of elastic band retaining structures 38 that extend upward from the ribs 40. The support ribs 40 are equally spaced apart in a grid pattern with the retaining members 38 extending from an intersection between the ribs 40. In one disclosed embodiment, the band retaining members 38 are pin portions that are integrally formed as part of the form 16. The shape of the example form 16 shown in FIG. 2 is substantially rectilinear with angled corners. As appreciated, other shapes and orientations of the ribs 40 and band retaining members 38 may be utilized and are within the scope and contemplation of this disclosure.

Figure 3:
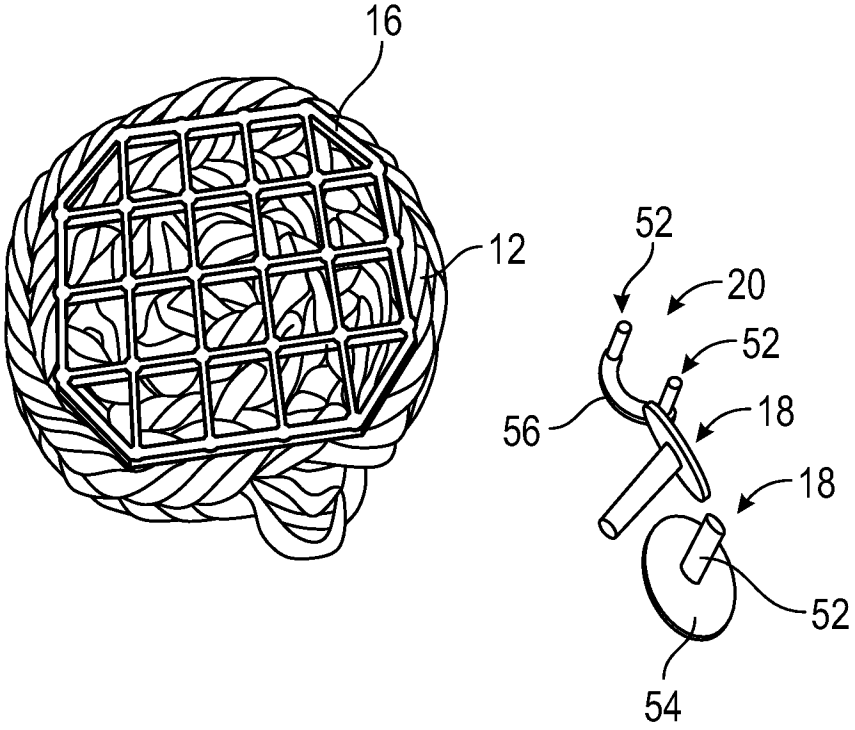
FIG. 3 is a perspective view of an exampled linked elastic band assembly assembled to an example form according to one disclosed example embodiment.

Referring to FIG. 3 with continued reference to FIG. 2, the form 16 is shown inserted into the linked elastic band assembly 12. The band retaining members 38 extend between elastic bands 15 of the linked elastic band assembly 12 such that frictional engagement between the retaining members 38 and the elastic bands 15 hold the liked elastic band assembly 12 on the form 16. The retaining members 38 include a height that corresponds with a thickness of the linked elastic band assembly 12. The linked elastic band assembly 12 defines the desired front portion of the model and the form 16 is covered from viewing from the front.

Figure 4:
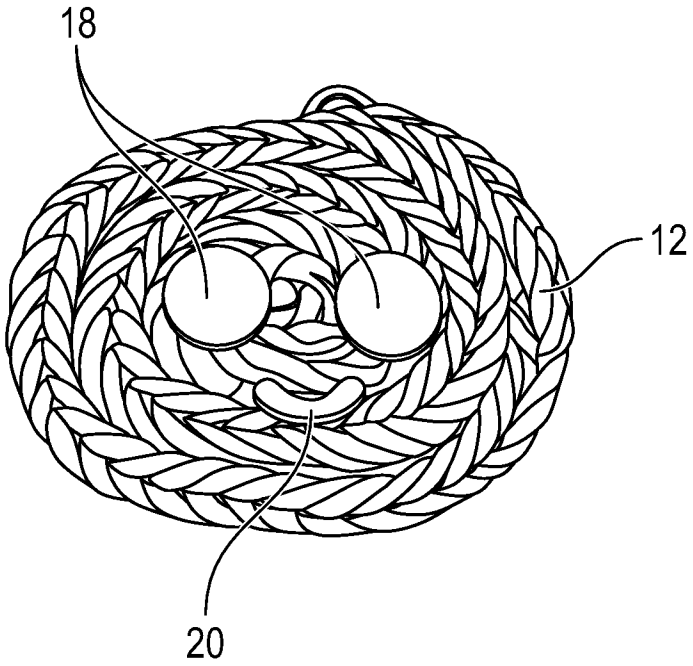
FIG. 4 is a front view of a portion of a partially assembled elastic band model including inserts according to one disclosed embodiment.

Referring to FIG. 4, with continued reference to FIGS. 2 and 3, the linked elastic band assembly 12 is turned shown from the front and form a shape of a face for the model. The form 16 is on a back side and is not substantially visible. The band retaining members 38 are of thickness, height and shape that is substantially hidden from view when looking at the front side. In one disclosed embodiment, the height of the band retaining members 38 are somewhat less than the thickness of the elastic band assembly 12 so that the retaining members 38 do not show through the front side shown in FIG. 4.

The inserts 18, 20 have pins that are inserted into the mass of the linked elastic band assembly 12 to provide the look of a face in the example shown in FIG. 4. The pins on each of the inserts 18, 20 are inserted between the linked elastic band assembly 12 and held in place by the frictional engagement therebetween. The linked elastic band assembly 12 include tightly linked elastic bands 15 and therefore when the pins of the insets 18, 20 are pushed between the elastic bands 15, the elastic bands 15 conform tightly around the pins and thereby, hold the insets 18, 20 in place.

It should be appreciated, that the example inserts 18, 20 include pins 52 and a front shape providing a desired shape. In this disclosed example, the inserts 18 include a front round shape 54 to simulate the look of eyes. The insert 20 includes pins 52 and a front curved line shape 56 to simulate the look of a mouth. The example inserts 18, 20 provide the look of eyes and a mouth, but other shapes could be utilized and are within the contemplation of this disclosure. Moreover, the number of pins 52 provided on each insert 18, 20 may be varied depending on the size and shape of that insert. In this example, the mouth shaped insert 20 has 2 pins 52 to hold the mouth 56 in a desired orientation. The eye insets 18 have only a single pin 52 that supports the front round shape 54. Accordingly, if a specific orientation is desired for any specific insert configuration, then additional pins can be added to hold it in a desired manner.

Figure 5:
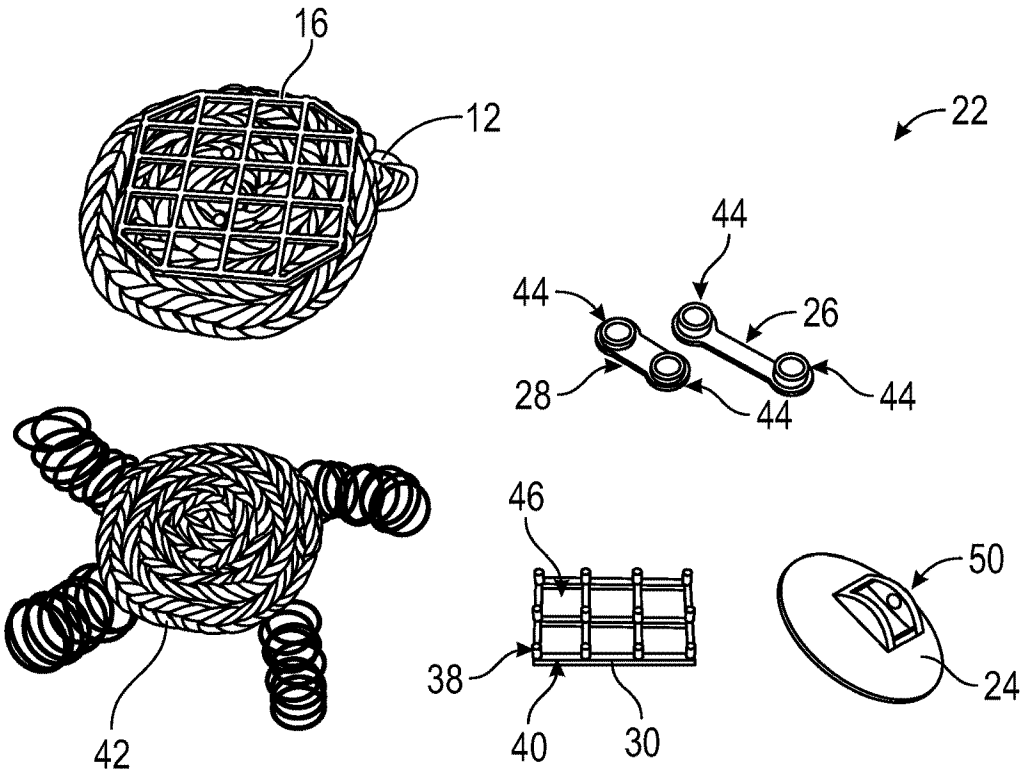
FIG. 5 is a perspective view of additional parts of the kit for making an elastic band model according to an example disclosed embodiment.

Referring to FIG. 5, additional items of the example kit 22 are shown and include a second form 30, connectors 26, 28 and a stand 24. Another elastic band structure 42 is shown that includes different colors and different shapes. In this disclosed example, the elastic band structure 42 includes outward extending appendages that appear as arms and legs that extend from a central body. The elastic band structure 42 is assembled to the form 30. Like the form 16, the form 30 includes band retaining structures in the form of pins 38 that extend upward from ribs 40. The example form 30 is substantially rectangular shaped with the ribs 40 equally spaced apart. The spacing between ribs 40 of the form 30 and that of the form 16 are substantially the same in one disclosed embodiment.

The connectors 26, 28 includes tabs 44 that are sized to fit within spacings 46 between ribs 40. The tabs 44 are circular and therefore provide for assembly at different angles and orientations when inserted into the spacings 46 between ribs 40 of the grid structure. The tabs 44 hold within the spacing 46 through an interference fit between the ribs 40. In this example, the connectors 26, 28 each have two ends with two tabs, however, the connectors could have additional ends with additional tabs. Moreover, in this example, the connector 26 is longer between the tabs 44 than the connector 28. Accordingly, connectors could be provided with different lengths to provide different options for assembly. Moreover, although two connectors are shown in the kit 22, any number of connectors could be included in the kit 22.

Figure 6:
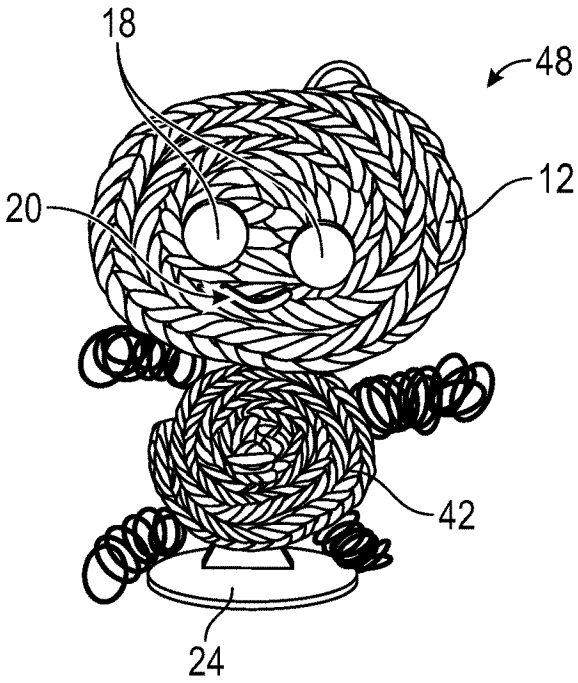
FIG. 6 is a front view of a completed elastic band model according to one example disclosed embodiment.
Figure 7:
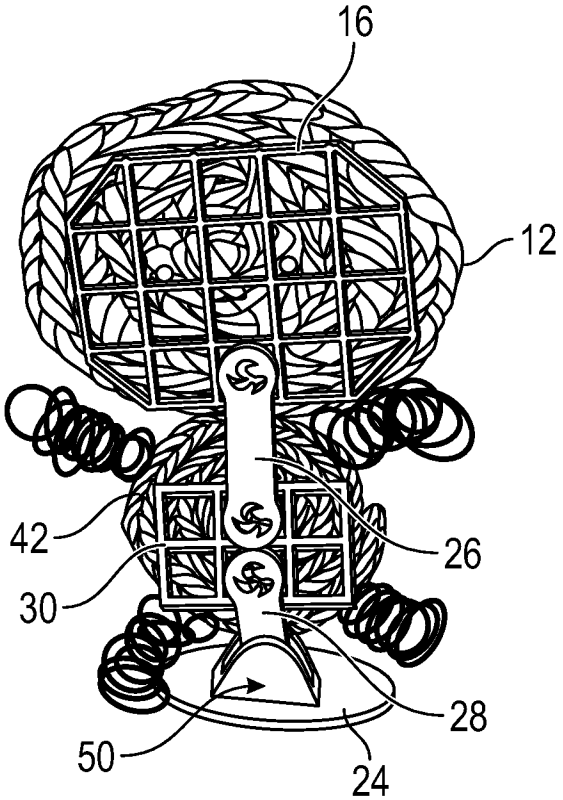
FIG. 7 is a rear view of the completed elastic band model according to one example disclosed embodiment.

Referring to FIGS. 6 and 7 with continued reference to FIG. 5, the example model 48 is shown assembled with the front side including the inserts 18, 12 and the back side including the connectors 26, 28 attached between the forms 16, 30. The connector 26 is attached on one end to the form 16 and on a second end to the form 30. The connector 28 is attached to the form 30 and extends into a pocket 50 of the stand 24. One of the tabs 44 of the connector 28 is received within the pocket 50. The tab 44 is fit within the pocket 50 of the stand 24 with an interference fit. The interference fit holds the forms 16, 30 upright to hold the completed model 48 for display.

Figure 8:
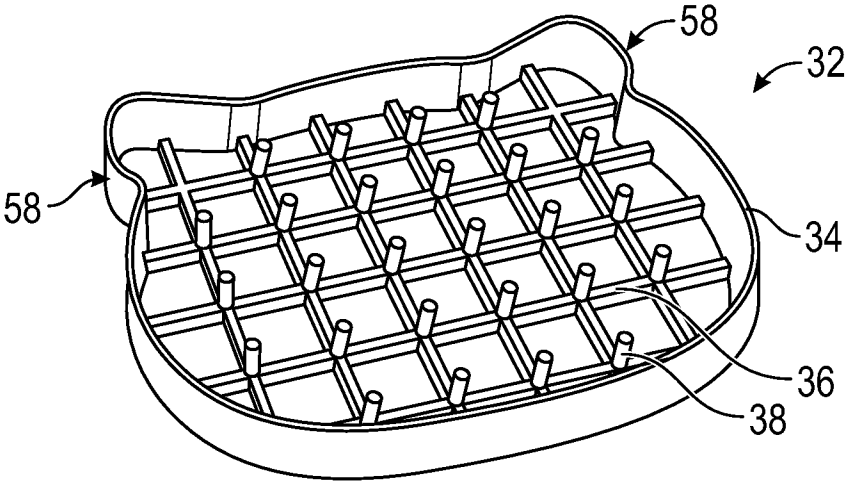
FIG. 8 is a perspective view of another example form according to one example disclosed embodiment.

Referring to FIG. 8, another example form 32 is schematically shown and includes a peripheral wall 34 that defines a desired shape. Within the peripheral wall 32 are ribs 36 and retaining members 38 similar to those in the previously discussed forms 16, 30. A linked elastic band assembly is gathered and received within walls 34 to fill the form 32. The peripheral wall 34 may be all that is utilized in the form to retain the elastic bands. Accordingly, in one example embodiment, the band retaining member comprises at least a portion of the peripheral wall. The band retaining members may therefore be either the peripheral wall or the pins 36, or a combination of both the peripheral wall and the pins 36.

Connectors and inserts may than be used to form different models as desired. The shape of the form 32 may be formed to provide different appendages and attachments to provide character specific shapes to provide different figures like the example figures and characters shown in FIG. 1. In this disclosed example, the form 32 includes the shape of a head of a character with ears 58. The shape of the form 32 provides for a more uniform look to a completed model. The shape provided by the peripheral wall 34 provides a more defined shape than can be easily formed using just linked elastic bands alone.

Figure 9:
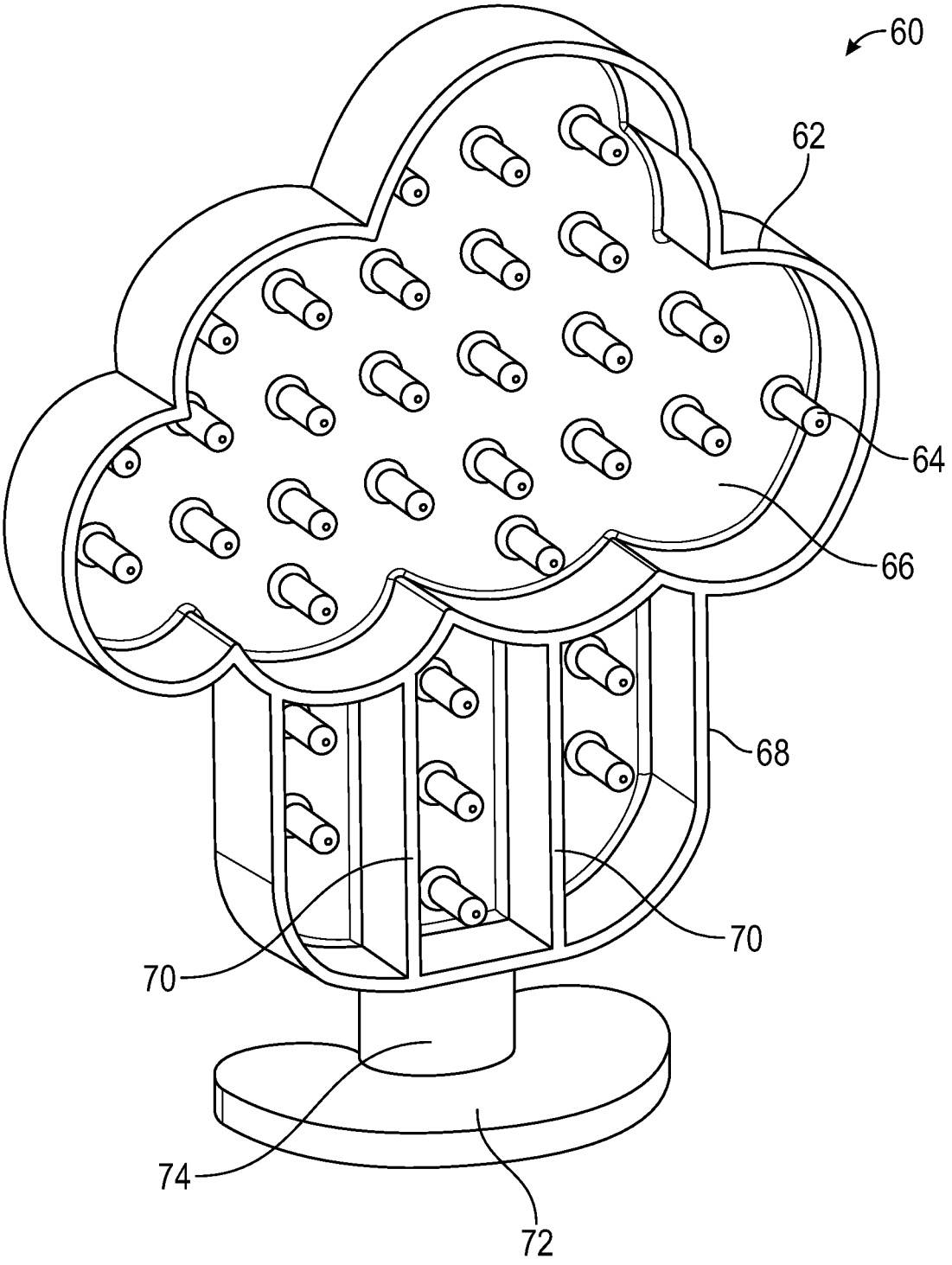
FIG. 9 is a perspective view of another example form according to another example disclosed embodiment.

Referring to FIG. 9, another example form 60 is shown and is made as a single integral part. The form 60 includes a top wall portion 62 that defines an upper shape of a model.

A linked elastic band assembly (not shown) is inserted into the form 60 within the top wall portion 62 and held in place by band retaining members 64. In this example, the band retaining members 64 are pins that extend from a back surface portion 66. The example form 60 further includes a bottom wall portion 68 that defines a lower portion of the model. The lower portion includes inner ribs 70 that divide the inner space within the bottom wall portion 68. Elastic bands of different colors can be inserted in to each different space to provide a desired appearance of the completed model.

A base portion 72 and stem portion 74 are provided as an integral part of the form 60. The base portion 72 an the stem portion 74 hold the form 60 in an upright position. The shape of the form 60 can be adapted and modified by changing the shape of the wall portions 62, 68 to define the shape of any character, object, thing or shape. In this example, the form 60 is a single unitary part with all of the features produced as one integral part.

Figure 10:
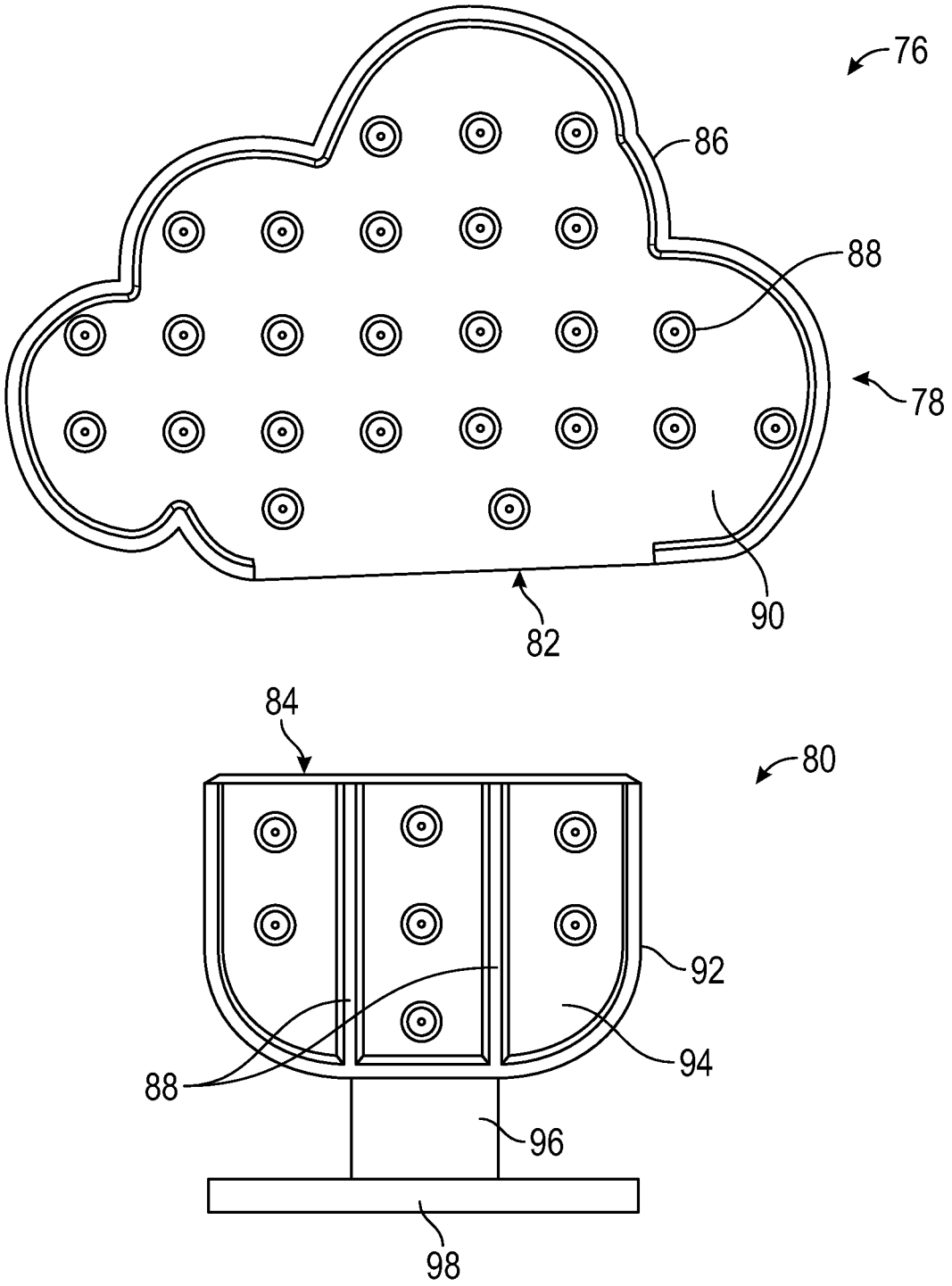
FIG. 10 is a front view of another example form according to another example disclosed embodiment.

Referring to FIG. 10, another example form embodiment is shown and indicated at 76. The form 76 includes a top portion 78 and a bottom portion 80 that are formed as separate parts. In this disclosed example, the top portion 78 includes wall portion 86 that extends partially about a periphery. An open portion 82 does not includes the wall portion 86. The lower portion 80 includes a lower wall portion 92 that extends only partially around a periphery. An open portion 84 is present that aligns with the open portion 82 in the top portion 78.

The top portion 78 is attachable to the bottom portion 80 to complete the model. The top portion 78 includes pins 88 that extend from a back wall 90. The example back wall 90 is a solid continuous part that extends across the top portion 78 between the top wall portion 86. The pins 78 provide for holding of a linked elastic band assembly as previously disclosed. The lower portion 80 includes integrally formed ribs 88 that divide the space between the lower wall portion 92. Pins 88 are also provided in this lower portion 80 to hold elastic band assemblies. A stem 96 and base 98 are provided to hold the completed model upright for display.

The example forms are fabricated from a molded plastic material. The plastic material may be of any color chosen to complement the models shape. Although plastic material is disclosed by way of example, other materials could be utilized to form the various features and structures of the disclosed models. Moreover, the forms and components disclosed herein may be formed using different forming processes and remain within the scope and contemplation of this disclosure.

Nothing in this disclosure is intended to limit the fabrication of any of the components as a single part or in multiple parts. The components maybe formed as a single integral part as illustrated in FIG. 9 and/or be formed separately formed components. Moreover, combinations of integrally formed components and forms could be utilized and are within the contemplation of this disclosure.

Accordingly, the disclosed example kit includes forms, inserts, stands and connectors that are used with link elastic bands to create of models, characters and other structures and shapes.

Although an example embodiment has been disclosed, a worker of ordinary skill in this art would recognize that certain modifications would come within the scope of this disclosure. Moreover, no part of disclosure is intended, either explicitly or implicitly, as any disclaimer or narrowing of claim scope. The description of any one embodiment is not intended, either explicitly or implicitly, as limiting the plain and ordinary meaning set out in the following claims. The example embodiment is only one of many possible structures and methods that are properly within the scope of this disclosure.

What is claimed is:

1. An elastic band model kit comprising:

a plurality of elastic bands for creating a linked elastic band item;

a device for supporting some of the plurality of elastic bands in place to facilitate creation of the linked elastic band item;

at least one form including a plurality of pins extending outward in a common direction from a grid structure, wherein the plurality pins provide for holding the linked elastic band item formed from the plurality of elastic bands, wherein the at least one form includes a peripheral wall that extends outward in a direction common with the pins and ribs that define the grid structure with the plurality of pins extending from the grid structure; and at least one insert that is securable to the linked elastic band item held within the peripheral walls and on the pins of the at least one form.

2. The elastic band model kit as recited in claim 1, wherein the at least one insert includes at least one pin that is insertable between at least two of the plurality of elastic bands forming the linked elastic band item.

3. The elastic band model kit as recited in claim 1, wherein the at least one form comprises at least two forms and the kit further including at least one connector configured to attach the at least two forms together, the connector having a tab on each of at least two distal ends that is press fit within a space defined between ribs of the grid structure.

4. The elastic band model kit as recited in claim 1, including a stand attachable to the at least one form to hold the at least one form in a desired upright orientation.

5. The elastic band model kit as recited in claim 1, wherein the peripheral wall extends about at least a portion of a periphery of the at least one form.

6. The elastic band model kit as recited in claim 1, wherein the peripheral wall extends entirely about a periphery of the at least one form.

7. The elastic band model kit as recited in claim 1, wherein the at least one form includes an integral base portion for holding the at least one form in a desired orientation.

8. The elastic band model kit as recited in claim 1, wherein the at least one form includes a lower form portion connectable to a top form portion, wherein the lower portion includes a stem and a base for holding the lower form and the top form in a desired orientation.

9. The elastic band model kit as recited in claim 1, wherein the form comprises a single unitary part with the peripheral wall, the plurality of pins, the grid structure and a base portion formed as a single integral part.

10. The elastic band model kit as recited in claim 1, wherein the device for supporting at some of the plurality of elastic bands comprises a loom.

11. An elastic band model comprising:

a plurality of elastic bands formed into a linked elastic band assembly;

a first form defining a shape of a portion of a model, the first form including a plurality of integrally formed and fixed pins extending outward in a common direction for holding the linked elastic band assembly to the first form, wherein and first form includes ribs that define a grid structure with the plurality of pins extending from the grid structure; and at least one insert configured to be held in place by friction between at least two of the linked elastic band assembly secured to the first form, wherein the insert forms a visible feature of the model.

12. The elastic band model as recited in claim 11, including at least one connector and a stand, the at least one connector attachable to the first form and to the stand.

13. The elastic band model as recited in claim 11, wherein the first form includes a peripheral wall forming a desired shape for a portion of the model.

14. The elastic band model as recited in claim 11, including a second form defining a second shape of the model, the second form attachable to the first form.

15. The elastic band model as recited in claim 14, wherein the first form and the second form are all separate individual parts.

16. The elastic band model as recited in claim 11, wherein the first form includes a peripheral wall and a stand as a single unitary part.

17. The elastic band model as recited in claim 11, further including a loom for creating the linked elastic band assembly.

18. An elastic band model kit comprising:

a plurality of elastic bands;

a loom for forming an elastic band assembly from a portion of the plurality of elastic bands;

a form defining a shape of a portion of a model, the form including a plurality of integrally formed and fixed band retaining members for holding the linked elastic band assembly to the form, wherein and form includes ribs that define a grid structure with the plurality of fixed band retaining members extending from the grid structure; and at least one insert configured to be held in place by the linked elastic band assembly, wherein the insert forms a visible feature of the model.

19. The elastic band model kit as recited in claim 18, wherein the plurality of band retaining members comprises a wall that extends at least partially along a periphery of the form.

20. The elastic band model kit as recited in claim 18, wherein the at least one band retaining member comprises at least one outward extending pin.

21. The elastic band model kit as recited in claim 18, including at least one connector for connecting the form to another component.

22. The elastic band model kit as recited in claim 18, wherein the form comprises a single unitary part.

23. The elastic band model kit as recited in claim 18, wherein the form comprises more than one part.

24. A method of forming a model from elastic bands comprising:

linking a plurality of closed loop elastic bands together to form a linked elastic band assembly; and assembling the linked elastic band assembly onto integrally formed and fixed retaining members on a form, wherein the form includes a periphery that defines a shape of at least a portion of the elastic band model, wherein the form includes ribs that define a grid structure with the retaining members extending from the grid structure.

25. The method as recited in claim 24, including assembling an insert into the linked elastic band assembly, the insert including a shape defining a feature of the model.

26. The method as recited in claim 25, including attaching the form to another form or a base with a connector.

27. The method as recited in claim 24, comprising holding at least some of the plurality of elastic bands on a loom to assembly the elastic band assembly.

* * * * *